United States Patent [19]

Hitoshi et al.

[11] Patent Number: 4,659,962

[45] Date of Patent: Apr. 21, 1987

[54] LOW PRESSURE DISCHARGE LAMP

[75] Inventors: Yamazaki Hitoshi, Yokohama; Takeda Takao, Chigasaki; Nakano Shizuo, Kamakura; Yamamoto Kouji, Kanagawa; Ito Hiroshi, Megurohonmachi; Imai Jun, Hiratsuka, all of Japan

[86] PCT No.: PCT JP84/00078
§ 371 Date: Feb. 22, 1985
§ 102(e) Date: Feb. 22, 1985

[87] PCT Pub. No.: WO85/04047
PCT Pub. Date: Sep. 12, 1985

[73] Assignee: Mitsubishi Denki Kabushiki Kaisha, Tokyo, Japan

[21] Appl. No.: 708,080
[22] PCT Filed: Mar. 2, 1984

[51] Int. Cl.[4] ..... H01J 61/30; H01J 61/36
[52] U.S. Cl. ..... 313/493; 313/634
[58] Field of Search ..... 313/493, 609, 611, 634

[56] References Cited

U.S. PATENT DOCUMENTS

| | | | |
|---|---|---|---|
| 4,199,708 | 4/1980 | Lauwerijssen et al. | 313/493 |
| 4,208,618 | 6/1980 | Heine | 313/493 X |
| 4,524,301 | 6/1985 | Cohen et al. | 313/493 |

FOREIGN PATENT DOCUMENTS

| | | |
|---|---|---|
| 55-43796 | 3/1980 | Japan . |
| 55-108163 | 8/1980 | Japan . |
| 55-133744 | 10/1980 | Japan . |
| 56-61758 | 5/1981 | Japan . |

*Primary Examiner*—Palmer C. DeMeo
*Assistant Examiner*—Sandra L. O'Shea
*Attorney, Agent, or Firm*—Oblon, Fisher, Spivak, McClelland & Maier

[57] ABSTRACT

The low pressure discharge lamp has at least one glass tube containing therein mercury and a rare gas and provided with a fluorescent layer on its inner wall and electrodes set up in a single base plate in an airtight manner, each end of the glass tube is bonded with an adhesive to the base plate in a condition that each of the electrodes are received in each of the open ends thereby to form a sealed space by the glass tube and the base plate. With the structure, damage of the glass tube in sealing process is prevented and the structure of the lamp is made compact while manufacture of the lamp can be easy.

3 Claims, 10 Drawing Figures

LOW PRESSURE DISCHARGE LAMP

TECHNICAL FIELD

The present invention relates to a low pressure discharge lamp such as a fluorescent lamp. More particularly, it relates to a low pressure discharge lamp having a curved glass tube to make its structure compact.

BACKGROUND ART

Generally, a fluorescent lamp is so constructed that electrodes are disposed at both ends of a linear glass tube and luminescence is caused by exciting gas contained in the glass tube due to electric discharge between the electrodes. The luminescence efficiency increases as the distance between the electrodes, namely, the length of electric discharge path is prolonged. Accordingly, if luminescence efficiency is considered to be important, use of a longer glass tube is advantagaeous. However, discharge lamps are used as light sources at a variety of positions and it may be desirable for users to have one having a compact structure which is convenient to handle it. On account of this, various proposals have been made as to a discharge lamp with a curved glass tube in order that luminescence efficiency is maintained at a high level to some extent while the size of the lamp is reduced by making its structure compact.

FIG. 1 shows a U-shaped fluorescent lamp as a typical example of the discharge lamp of this kind, in which glass stems 3, each holding an electrode 2, are sealingly provided at both ends in a U-shaped glass tube 1 having an inner wall on which a fluorescent layer 11 are formed.

The fluorescent lamp having the construction described above is utilized in fields requiring a compact light source since such lamp imparts substantially the same luminescence characteristic as an ordinary fluorescent lamp using a linear glass tube although the length of the lamp is one-half.

However, the discharge lamp having the construction as above-mentioned has the disadvantage that manufacturing steps are complicated in comparison with the conventional discharge lamp using a linear glass tube. Particularly, it is difficult to attach a glass stem to the end portion of the glass tube 1 to seal it. Namely, a general method of seal-bonding a glass stem 3 to the end of the glass tube 1 is such that the glass stem 3 is brought to contact with the end of the glass tube which is previously bent into a U-shape; heat is applied to the periphery of the contacting part by a gas burner (not shown) to soften that portion thereby causing melt-bonding of the glass stem to the glass tube.

In the discharge lamp having the shape as shown in FIG. 1, however, since both parts to be sealed are placed contiguously each other, it is difficult to apply heat from the burner to those parts to thereby possibly cause defect such as cracking during sealing operations. Further, the conventional discharge lamp is not always sufficient in view of making the structure compact because a linear glass tube is bent only one time.

FIG. 2 shows a fluorescent lamp aiming at its compact structure disclosed in Japanese Unexamined Publication No. 83147/1980 in which the fluorescent lamp has a base plate 23 whose one surface is attached with a lamp base 9 integrally and whose other surface is firmly secured to a glass tube 1 as a luminescence tube. The glass tube 1 is formed into a saddle shape in general by bending a linear glass tube at its intermediate portion into a U-shape and further bending the U-shaped glass tube by 180° in the direction perpendicular to the axis of the bending. Reference numerals 3 designate stems attached to and sealed in both ends of the glass tube 1 and numerals 2 designate electrodes extending from the stems 3.

In the discharge lamp having the construction as above-mentioned, bending operations of the glass tube are more complicated because a single linear glass tube is bent into a U-shaped glass tube and it is further bent into double U-shapes. Furthermore, in the second bending operations, two portions in the glass tube are simultaneously bent and accordingly, if a large curvature is taken, there may result in defect in the glass tube formation. Therefore, there has been restriction in making structure of discharge lamps compact.

SUMMARY OF THE INVENTION

It is an object of the present invention to eliminate the disadvantage of the conventional discharge lamp and to provide a low pressure discharge lamp for preventing breaking of a glass tube in sealing process and making its manufacturing work easy, which comprises base plate, electrodes attached to the base plate in an airtight manner and at least one glass tube whose both open ends are sealingly bonded to the base plate with an adhesion while the both open ends receives therein the electrodes, to form a sealed space between the glass tube and the base plate.

It is another object of the present invention to provide a low pressure discharge lamp comprising a base plate provided with electrodes and through holes and at least one glass tube each open end of which is bonded to the base plate with an adhesive under condition that each of the electrodes is contained in each of the open end, certain open ends of the glass tube being connected each other through the through holes of the base plate, whereby at least the second bending operation to form a U-shape of the glass tube is eliminated to thereby simplify the manufacturing steps and enable to make the construction of the lamp compact.

BEST MODE CARRYING OUT THE INVENTION

Figure 1:
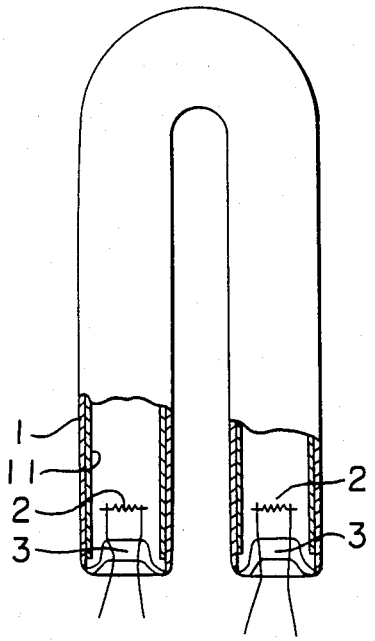
FIG. 1 is a front view partly cross-sectioned showing the construction of the conventional U-shaped fluorescent lamp.
Figure 2:
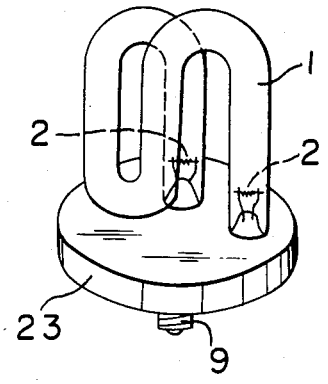
FIG. 2 is a perspective view showing a fluorescent lamp formed by further bending the conventional U-shaped glass tube.
Figure 3:
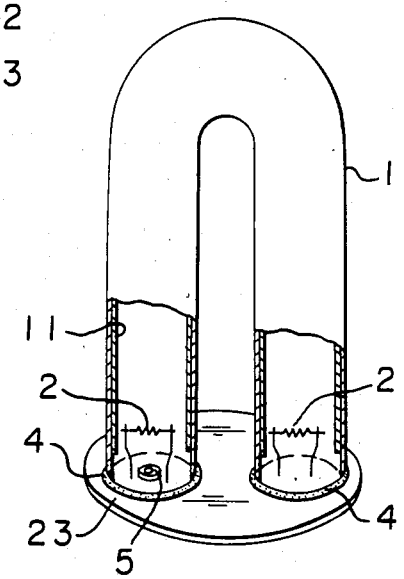
FIG. 3 is a perspective view of an embodiment of the fluorescent lamp of the present invention

An embodiment of the present invention will be described with reference to FIG. 3.

A reference numeral 23 designates a base plate in a circular form which is made of ceramics and through which a pair of electrodes 2 pass while keeping airtight condition and numeral 1 refers to a U-shaped glass tube with both open ends attached to a surface of the base plate 23, each open end of the glass tube containing therein each of the electrodes 2. The interior of glass tube 1 forms an airtight space by bonding the contacting portion of the open end to the base plate 23 with an adhesive of glass frit 4. On the inner surface of the U-shaped glass tube 1, a fluorescent layer 11 is formed. A discharge pipe 5 made of glass is passed through and bonded to the base plate 23 with glass frit 4 at the central portion of one of the electrodes. A small amount of argon and mercury are introduced into the glass tube after the glass tube is vacuumed through the discharge pipe 5.

Incidentally, use of soda lime glass is made to the U-shaped glass tube 1; use of forsterite having a thermal expansion coefficient approximate to that of the soda lime glass to the ceramic base plate 23 and low melting point glass powder composed mainly of a boric acid and a lead oxide is used for the glass frit 4 for sealing the both glass tube and base plate.

In the fluorescent lamp having the construction described above, the end portion of the glass tube 1 is bonded to the base plate 23 with the glass frit 4 to seal them. The sealing can be easily done by using a simple way such that the glass frit 4 is applied to the base plate 23; putting the lower ends of the glass tube 1 on the glass frit 4 coated on the base plate and passing thus assembled product through a heat oven (not shown). This process, therefore, provides extremely stable sealing effect in comparison with the conventional one in which heat is applied to the glass stem 3 and the glass tube 1 to melt-bond them.

Further, the product obtained by bonding the both ends of the glass tube 1 to a single base plate 23 increases its strength and is hardly broken even when an external force is applied to it during treatment or transportation.

Figure 4:
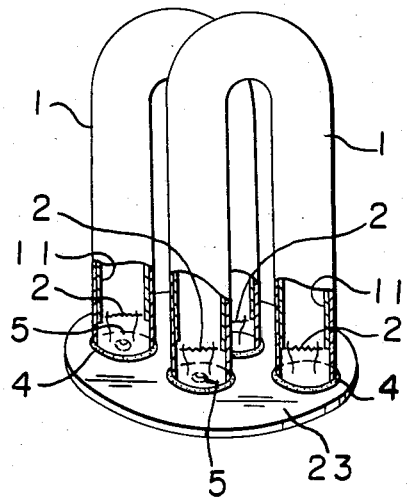
FIG. 4 is a perspective view of another embodiment of the fluorescent lamp according to the present invention.

FIG. 4 shows another embodiment of the present invention in which two pairs of electrodes 2 are set up on the single and same base plate 23 and two separate U-shaped glass tubes are bonded to the base plate 23 so that open ends of the respective glass tubes contain therein respective pair of electrodes in airtight manner. The discharge lamp as above-mentioned can also be easily prepared in the same manner as in that of FIG. 3, while there is obtainable luminescence characteristic corresponding to the conventional lamp having two U-shaped glass tubes. It is, therefore, suitable for requirement of small-sized, high output light source.

Figure 5:
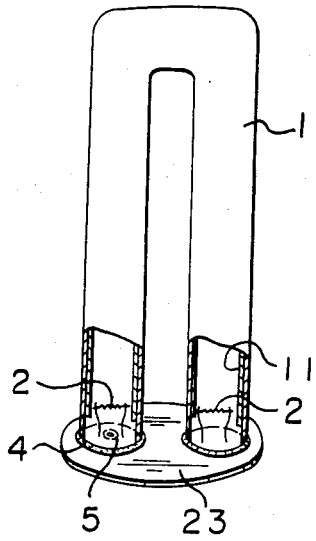
FIG. 5 is a perspective view showing a modification of the lamp shown in FIG. 3.
Figure 6:
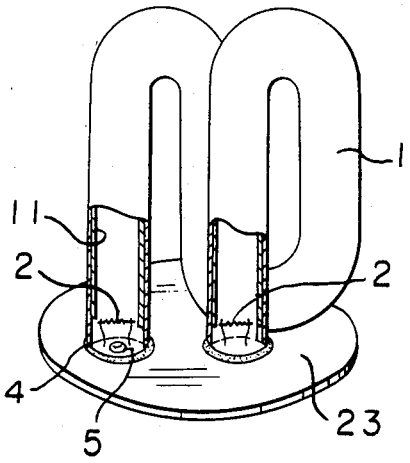
FIG. 6 is a perspective view showing another modification of the lamp shown in FIG. 3.
Figure 7:
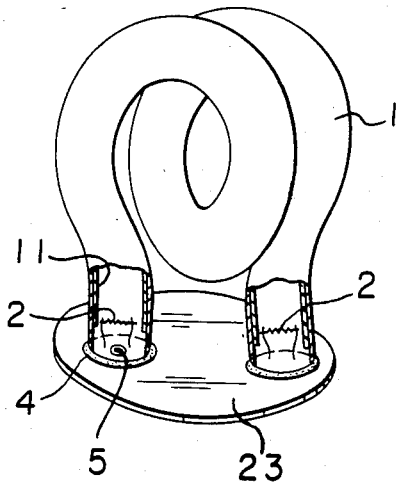
FIG. 7 is a perspective view showing still another modification of the lamp shown in FIG. 3.

FIGS. 5, 6 and 7 respectively show embodiment of the present invention in which the curved glass tubes have different shapes. These lamps can also be easily prepared by using the sealing method as described with reference to FIG. 3.

In the embodiments above-mentioned, ceramics is used as the material of the base plate 23. It may, however, be other material having thermal expansion coefficient approximate to that of the glass tube 1, such as, for example, chromium steel.

In the next place, still another embodiment of the present invention will be described with reference to FIGS. 8 and 9.

In the Figures, there is shown a circular ceramic base plate 23 which is divided into two parts along a radial direction, i.e. a bottom part 12 and a cover part 13 covering the entirety of one surface of the bottom part 12. An elliptic through hole 15 is formed in the half area of the bottom part 12 and two circular through holes 14 are formed in the cover part 13. The through holes 14 are brought above the elliptic hole 15 at the time of bonding the bottom part 12 and the cover part 13 with an adhesive with the consequence that a communication hole 8 having the through holes 14 as open ends is formed. The reference numerals 2 designate two electrodes extending from a semi-circular area of the cover part 13 which opposes an area where two through holes 14 are formed and lead wires 16 to support the electrodes 2 are led out through the bottom part 12.

Two glass tubes 1 each being bent into a U-shape and having open ends are attached to the base plate 23 so that respective one ends of the glass tubes are sealingly bonded with the adhesive 4 to the cover part 13 containing therein the electrode 2 and the other ends are sealingly bonded with the adhesive 4 to the cover part 13 around the periphery of the respective through holes 14 whereby these other ends are communicated through the communication hole 8. A numeral 11 designates a fluorescent layer coated on the inner wall of the glass tubes 1 which contain therein specified amount of mercury and a rare gas such as argon gas. A numeral 9 designates a base metal 9 bonded to the base plate 23 with its side surface bonded with an adhesive (not shown). Numerals 10 designate terminals of a conductive material which are attached to the bottom surface of the base metal 9 to be electrically connected with the lead wires 16 supporting the electrodes 2.

In the fluorescent lamp having the construction above-mentioned, when a voltage is applied across the electrodes 2 through the terminals 10, there takes place an electric discharge through an electric path formed by: one of the electrodes 2→one of the glass tubes 1→the recess 2 of base plate→the other of the glass tubes 1→the other of the electrodes 2. Namely, there is obtained an electric discharge path similar to that shown in FIG. 6 where each one end of two U-shaped glass tubes is connected each other.

Figure 8:
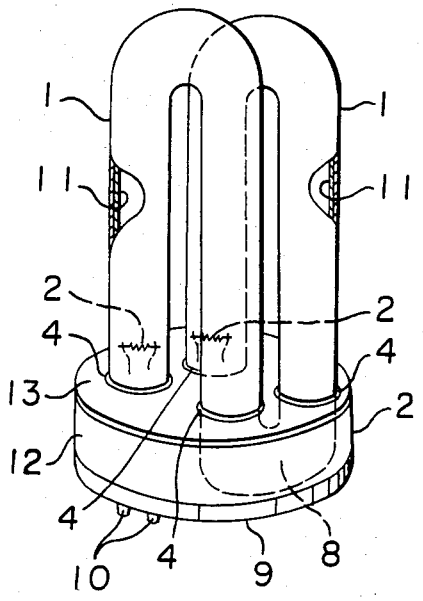
FIG. 8 is a perspective view of a still another embodiment of the present invention.
Figure 9:
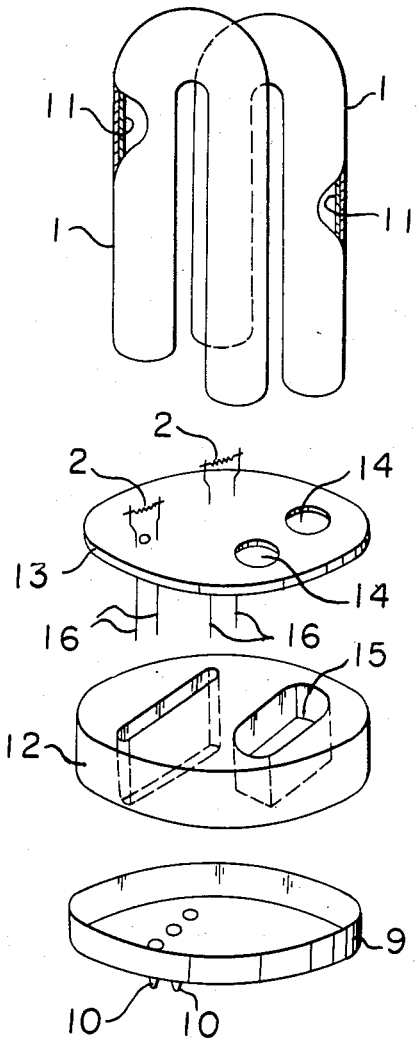
FIG. 9 is an exploded view of FIG. 8.

In this way, it is easy to prepare a fluorescent lamp of the embodiment shown in FIGS. 8 and 9 since the only one of bending operation to the glass tube 1 to form a U-shape is sufficient. Furthermore, with the single bending structure, it is possible to give a large curvature to a portion to be bent so that both leg portions of the glass tube 1 are brought to a close juxtaposition. Also, even in use of two glass tubes, this relationship is applicable. Accordingly, all the legs of the glass tubes 1 can be gathered closely to the central axis of the base plate 23 whereby a further compact structure of the lamp is obtainable.

Figure 10:
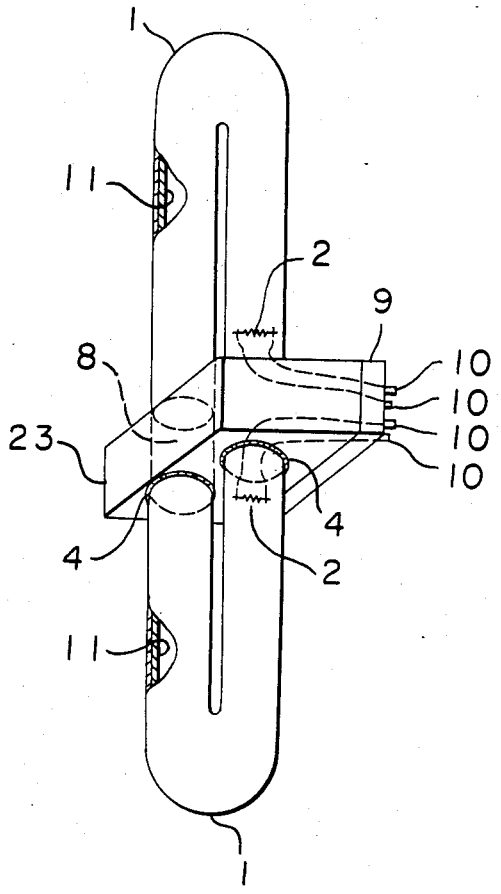
FIG. 10 is a perspective view of a separate embodiment of the fluorescent lamp according to the present invention.

In the embodiment shown in FIGS. 8 and 9, the base plate 23 is divided in its radial direction into two parts. The present invention is not limited to the embodiment and it is possible that only upper portion of the base plate is divided at a position related at least to the communication hole 15 or without dividing the base plate 23, a communication hole 8 is formed to provide openings at the side surfaces of the base plate 23 as shown in FIG. 10. In this case, if the electrodes 2 are provided at positions corresponding to each of the openings, a low pressure discharge lamp making its manufacture easy and of a fresh design can be obtained.

Further, when soda glass or lead glass is used for the glass tube 1, ceramics is suitable for the base plate 23. It is, however, possible to use the same glass material as the glass tube 1.

We claim:

1. A low pressure discharge lamp comprising:

a base plate including a cover part and a bottom part;

one pair of electrodes extending through said base plate and being sealed thereto;

two glass tubes coated with a fluorescent layer on their inner walls and each having two open ends brought into juxtaposition by the bending of the tubes;

said cover part having two holes with each hole being smaller than an open end of said glass tubes;

said bottom part having an opening in communication with said two holes, said opening having a width equal to the width of said holes and a length equal to the distance from opposite sides of opposite holes;

said glass tubes being sealingly bonded with an adhesive to said base plate so that one open end of each glass tube receives one of said electrodes while the other open end of each of said glass tubes is sealingly bonded to said base plate so as to be in communication with one of said holes, said glass tubes being connected in series through said holes in said opening.

2. The low pressure discharge lamp according to claim 1, wherein said base plate is made of ceramics.

3. A low pressure discharge lamp comprising:

a base plate;

a pair of electrodes mounted on said base plate and being sealed thereto, said electrodes extending from opposite surfaces of said base plate and in opposite directions from each other;

two glass tubes being coated with a fluorescent layer on their inner walls, each tube having open ends which are brought into juxtaposition by a bending of the tubes;

a through hole being formed in said base plate so that said through hole connects opposite surfaces of said base plate;

said tubes being sealingly bonded to said base plate so that one open end of each tube receives one of said electrodes while the other end of each tube is in communication with said through hole.

* * * * *